US009663979B2

(12) United States Patent
Dreisewerd et al.

(10) Patent No.: US 9,663,979 B2
(45) Date of Patent: May 30, 2017

(54) RECESSED ADJUSTABLE DOOR HINGE

(71) Applicant: SIMONSWERK GmbH, Rheda-Wiedenbrueck (DE)

(72) Inventors: Nikolaus Dreisewerd, Reitberg (DE); Sergei Gorenbacher, Rheda-Wiedenbrueck (DE)

(73) Assignee: SIMONSWERK GMBH, Rhed-Wiedenbrueck (DE)

( * ) Notice: Subject to any disclaimer, the term of this patent is extended or adjusted under 35 U.S.C. 154(b) by 0 days.

(21) Appl. No.: 15/269,566

(22) Filed: Sep. 19, 2016

(65) Prior Publication Data

US 2017/0089108 A1 Mar. 30, 2017

(30) Foreign Application Priority Data

Sep. 24, 2015 (DE) ..... 10 2015 116 192

(51) Int. Cl.
*E05D 7/04* (2006.01)

(52) U.S. Cl.
CPC .... *E05D 7/0415* (2013.01); *E05D 2007/0469* (2013.01); *E05D 2007/0476* (2013.01); *E05D 2007/0484* (2013.01); *Y10T 16/53225* (2015.01)

(58) Field of Classification Search
CPC ..... Y10T 16/53225; Y10T 16/53253; Y10T 16/53257; Y10T 16/541; E05D 7/0423; E05D 7/0415; E05D 2007/0469; E05D 2007/0476; E05D 2007/0484; E05D 3/122; E05Y 2900/132; E05Y 2900/20
USPC ..... 16/238, 245, 246, 354
See application file for complete search history.

(56) References Cited

U.S. PATENT DOCUMENTS 5,694,665 A * 12/1997 Strickland ..... E05D 7/0423 16/237
5,701,636 A * 12/1997 Jahnke ..... E05D 7/0423 16/237
6,829,808 B2 12/2004 Neukoetter
7,334,293 B2 * 2/2008 Erickson ..... E05D 7/0423 16/243
7,552,511 B2 * 6/2009 Campbell ..... E05D 7/0423 16/236
7,676,887 B2 * 3/2010 Chung ..... E05D 7/0423 16/236
8,429,794 B2 * 4/2013 Tagtow ..... E05D 7/0423 16/235

(Continued)

FOREIGN PATENT DOCUMENTS

WO 2015149495 A 10/2015

*Primary Examiner* — William Miller
(74) *Attorney, Agent, or Firm* — Andrew Wilford

(57) ABSTRACT

A hinge has two housings adapted to be recessed in a door frame and a door edge and a link assembly extending between the housings and having ends pivoted in the housings. A vertically shiftable support body in one of the housings has a row of teeth extending horizontally in a first direction. A bearing block sitting on the support body forms a pivot for the respective end of the link assembly. A screw extending through the bearing block and threaded into the support body is tightenable to bear on and fix the bearing block on the support body. A gear captured in the seat of the bearing block meshes with the row of teeth and is rotatable to shift the bearing block on the support body in the first horizontal direction in an untightened condition of the screw.

17 Claims, 3 Drawing Sheets

(56) References Cited

U.S. PATENT DOCUMENTS

2011/0296652 A1* 12/2011 Zhang ..... E05D 7/0027
16/239

* cited by examiner 1
2
4
A
32
3
9
8
24
22
4
18
6
16
5
7

RECESSED ADJUSTABLE DOOR HINGE

FIELD OF THE INVENTION

The present invention relates to door hinge. More particularly this invention concerns such a hinge that is recessable and adjustable.

BACKGROUND OF THE INVENTION

A typical recessed hinge has two hinge parts adapted to be recessed, one in a door frame and one in an edge of a door panel. A link assembly extending between the hinge parts allows the door to pivot in the frame about a vertical axis, frequently through an angle of up to 180°. When the door is closed, such a hinge is normally completely concealed.

At least one of the hinge parts is provided with a mechanism that allows the hinge to be adjusted in three mutually perpendicular directions, that is front-to-back horizontally perpendicular to the vertical plane of the door frame, horizontally side-to-side parallel to this plane and perpendicular to the vertical pivot axis of the hinge, and vertically parallel to the hinge pivot axis. This way the door can be perfectly centered in the frame and, with the front-to-back adjustment, the amount of compression of a seal in the frame can be controlled. When at least two such hinges are provided with their pivot axes coaxial, it is also possible to ensure that the door is perfectly vertical or, if a closing or opening movement is desired, at a slight angle to the vertical.

Such a hinge that is fully concealed between the frame and the door when the door is closed and not visible on the outside of the door is typically used for doors for residential and office spaces as well as interior and exterior building doors. The doors may have considerable weight, and therefore the door hinges and their components must meet stringent requirements for dimensional stability and continual load. In principle, the hinge system is also usable for windows and other building closures.

Normally one of the hinge parts of this invention allows vertical adjustment of the door relative to the frame and also a front-to-back compression adjustment of the door whereas the other can be responsible for the other horizontal adjustment parallel to the door plane. The vertical adjustment as well as the compression adjustment of the door are of crucial importance for doors equipped with a recessed door hinge. For design reasons, recessed door hinges are frequently used in doors whose doors end in flush alignment with the door frame, with a reveal remaining between the door and the door frame. The door must be adjusted in such a way that the reveal has constant dimensions over the entire periphery of the door in the closed state. Even minor deviations are perceived as having an extremely unattractive appearance. The compression adjustment of the door as well as the vertical adjustment of the door must therefore work with high precision. During adjustment, the entire weight of the door must be borne by the hinge structure in order to precisely adjust the door position. After adjustment, all mutually movable parts must be fixed connectable to one another so that the door does not shift, even under continual load.

A hinge part for a recessed door hinge for doors is known from WO 2015/149495. It has a housing for fastening to a frame or door, a support body adjustably mounted in a cavity of the body, and a bearing block for connecting links of the link assembly. The bearing block has a rotatable pinion meshing with teeth on the support body, thus allowing a horizontal adjustment of the bearing block. Vertical adjustment of the door hinge is provided on another separate hinge part.

A recessed-mount door hinge between a door frame and a door is also known from U.S. Pat. No. 6,829,808. This door hinge also has a first hinge part and a second hinge part joined together by a link assembly. The two hinge parts are insertable into mortises in the door frame and in an edge of the door. Each of the two hinge parts has a housing for fastening to a frame or a door and bearing blocks for connecting links of the link assembly. Each of the bearing blocks of the first hinge part is vertically adjustable in a guide recess in the respective housing. The bearing blocks of the other hinge part are horizontally adjustably mounted in the respective housing. Adjusting eccentrics are provided for the horizontal adjustment as well as for the vertical adjustment. It is disadvantageous that the vertical adjustment and the lateral adjustment of the door must be carried out on different hinge parts. In addition, the precision of the adjustment, in particular the compression adjustment of the door, is still in need of improvement.

OBJECTS OF THE INVENTION

It is therefore an object of the present invention to provide an improved door hinge.

Another object is the provision of such an improved door hinge that overcomes the above-given disadvantages, in particular that allows biaxial adjustment for vertical adjustment of the door and for compression adjustment. In addition the hinge part according to the invention should allow precise compression adjustment of the door or window leaf, and must be suited in particular for heavy doors.

Another aspect is the combination with a device for vertical adjustment of the door to allow precise vertical adjustment while accommodating heavy loads.

SUMMARY OF THE INVENTION

A hinge according to the invention has two housings adapted to be recessed in a door frame and a door edge and a link assembly extending between the housings and having ends pivoted in the housings. A support body is vertically shiftable in one of the housings and has a row of teeth extending horizontally in a first direction, and a bearing block supported in the housing on the support body forms a pivot for the respective end of the link assembly and is formed with a seat open toward the row of teeth and with a throughgoing block hole extending in a second horizontal direction transverse to the first horizontal direction. A screw threaded into the support body extends through the block hole and is tightenable to bear on and fix the bearing block on the support body. A gear captured in the seat of the bearing block meshes with the row of teeth and is rotatable to shift the bearing block on the support body in the first horizontal direction in a loosened condition of the screw.

The bearing block is advantageously linearly movably guided on guide surfaces of the housing. Stepped surfaces or grooves that cooperate with a countersurface or a projection are suitable as guide surfaces. Within the scope of the invention, however, the screw connection may also be used to horizontally guide the bearing block on the support body. According to one preferred embodiment of the invention, the screw connection between the bearing block and the support body has two screws passing through horizontally oriented elongated holes in the bearing block. The screw connection allows a fixed, permanent connection between the bearing block and the support body. After the screw connection is loosened, the described arrangement may be used to linearly move the bearing block along the housing and adjust it. The pinion on its freely accessible end-face side has an externally accessible connecting formation for a rotary tool. Rotation of the pinion meshing with the teeth adjust the bearing block precisely in the horizontal direction for compression adjustment of the door.

The support body is preferably designed as a die-cast part, and advantageously has a projection formed with the row of teeth. According to one particularly preferred embodiment of the invention, a rear side of the projection facing away from the teeth has a wedge face acted on by a vertical adjustment device. The pinion for the compression adjustment of the bearing block and the wedge face for vertically adjusting the support body are integrated into the hinge housing in a space-saving manner. The arrangement is characterized by high dimensional stability.

According to the invention, vertical adjustment is effected by a wedge having a pressure face complementary to the wedge face of the projection integrally formed on the support body, and that may be pressed against the support body by an adjustment screw. The wedge face and the complementary pressure face advantageously have an inclination angle of approximately 45°. The actuating movement of the adjustment screw horizontally relatively shifts the wedge and the wedge-shaped projection formed onto the support body. The angled faces convert the horizontal movement into a vertical adjustment of the support body. The wedge is slides on a surface of the housing. As a result, the arrangement is able to carry out the vertical adjustment under load and accommodate the weight of a door which acts on the arrangement.

The support body is fixable to the body by a screw connection. The screw connection has at least one adjustment screw passing through a vertically oriented elongated hole in the support body. The vertical adjustment described above may be carried out after the screw connection is loosened. After the desired position is set, the support body and the body may be fixedly joined together by tightening of the screw connection.

The bearing block is preferably a die-cast part, and has a gear seat for the pinion gear. The gear seat surrounds the pinion by more than 180°. As a result of this arrangement, the pinion is supported in the correct position in the support body, using simple technical means. The pinion may have a collar engaging behind a countersurface of the bearing block and axially securing the pinion in the gear seat against horizontal movement perpendicular to a horizontal rotation axis of the pinion gear.

The bearing block is coordinated with the structural design of the link assembly. One advantageous embodiment of the invention provides that the bearing block has a groove for longitudinally guiding a first link, and a bearing hole for rotationally supporting a second link of the link assembly.

The housing may be a die-cast part, and preferably has the shape of a housing which has an installation space, open on the end-face side, for the support body and the bearing block.

A further aspect of the invention relates to a recessed-mount door hinge between a door frame and a door, having a first hinge part and a second hinge part joined together in an articulated manner by a link assembly. The two hinge parts are insertable into mortises in the door frame and into an edge of the door. The first hinge part, which is preferably mounted in a mortise in the door frame, has a hinge housing on its upper end and on its lower end which has the design described above. The links of the link assembly are supported on the bearing blocks of the two hinge parts.

According to one advantageous embodiment, the bearing blocks of the two hinge parts are situated on respective housings. The housings the two hinge parts situated therein form separate assemblies which are not connected to the middle part. This middle part may in particular be designed as a thin-walled shell having a base and at least one side wall, the side wall bridging the distance between the bearing blocks and having a height that corresponds to the depth of the mortise.

Within the scope of the invention, however, the first hinge part may also have a housing insertable into an associated mortise in the door frame or into the edge of the door, and the housings of the two hinge parts may be integral parts of the housing.

The second hinge part may have an adjustment device via which a bearing arrangement of the links of the link assembly is horizontally adjustable in the depth direction of the respective mortise. The door hinge may be adjusted in a second horizontal direction by using this adjustment device of the second hinge part. In addition to the above-described adjustment in the vertical direction and the horizontal direction for compression adjustment of the door, the adjustment device of the second hinge part also allows a so-called lateral adjustment of the door in order to laterally adjust the door.

BRIEF DESCRIPTION OF THE DRAWING

The above and other objects, features, and advantages will become more readily apparent from the following description, reference being made to the accompanying drawing in which.

SPECIFIC DESCRIPTION OF THE INVENTION

Figure 1:
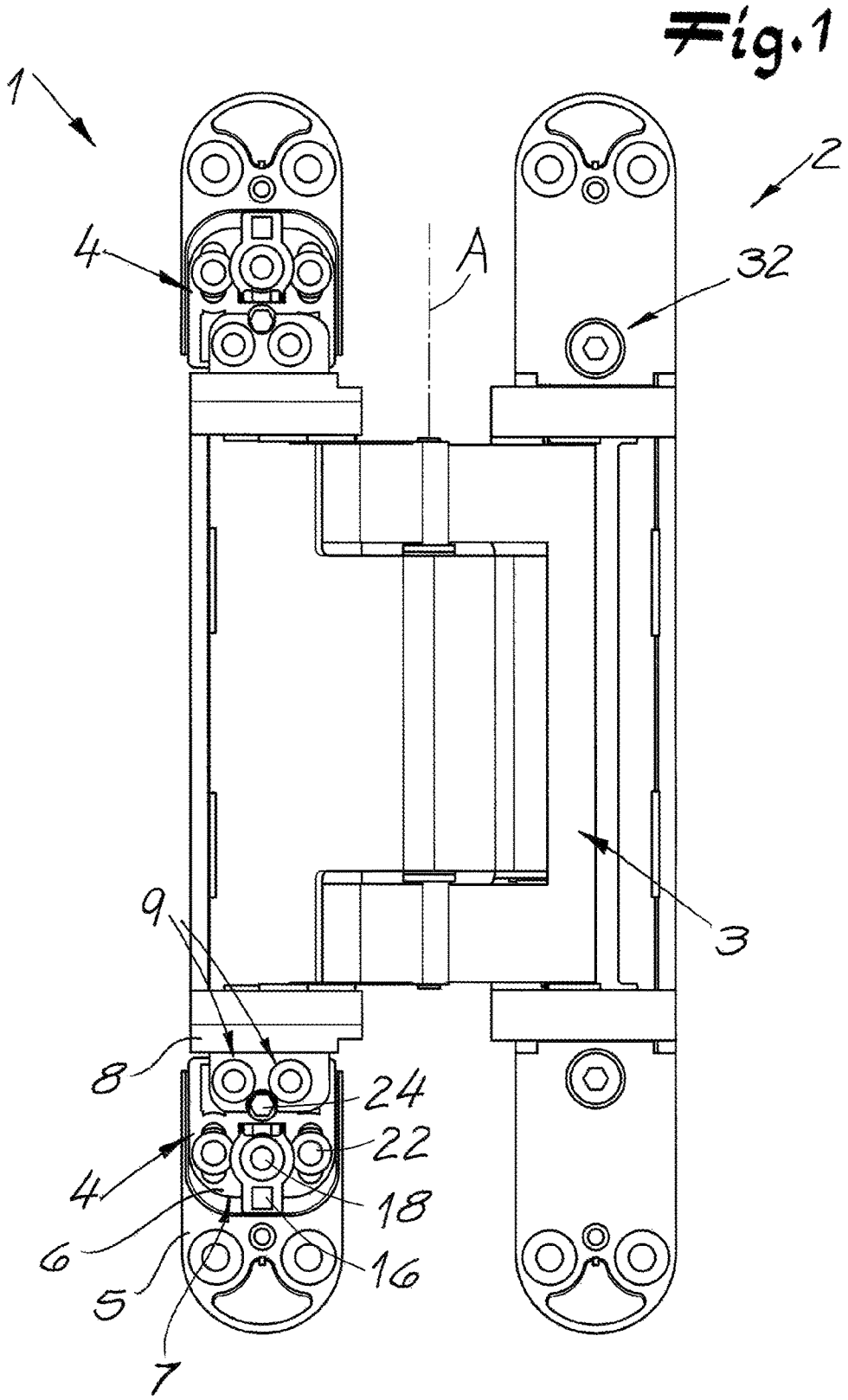
FIG. 1 shows a recessed-mount door hinge between a door frame and a door.

As seen in FIG. 1 a recessed-mount door hinge between an unillustrated door frame and door has a first hinge part 1, a second hinge part 2, and a link assembly 3 connecting the two hinge parts 1 and 2 for relative pivoting about a vertical axis A. The two hinge parts 1 and 2 fit into respective mortises in the door frame and in an edge of a door. On its upper and lower ends the first hinge part 1 has hinge housings 4 that are described below with reference to FIGS. 2 to 4. The second hinge part 2 is of similar but simpler construction.

Figure 2:
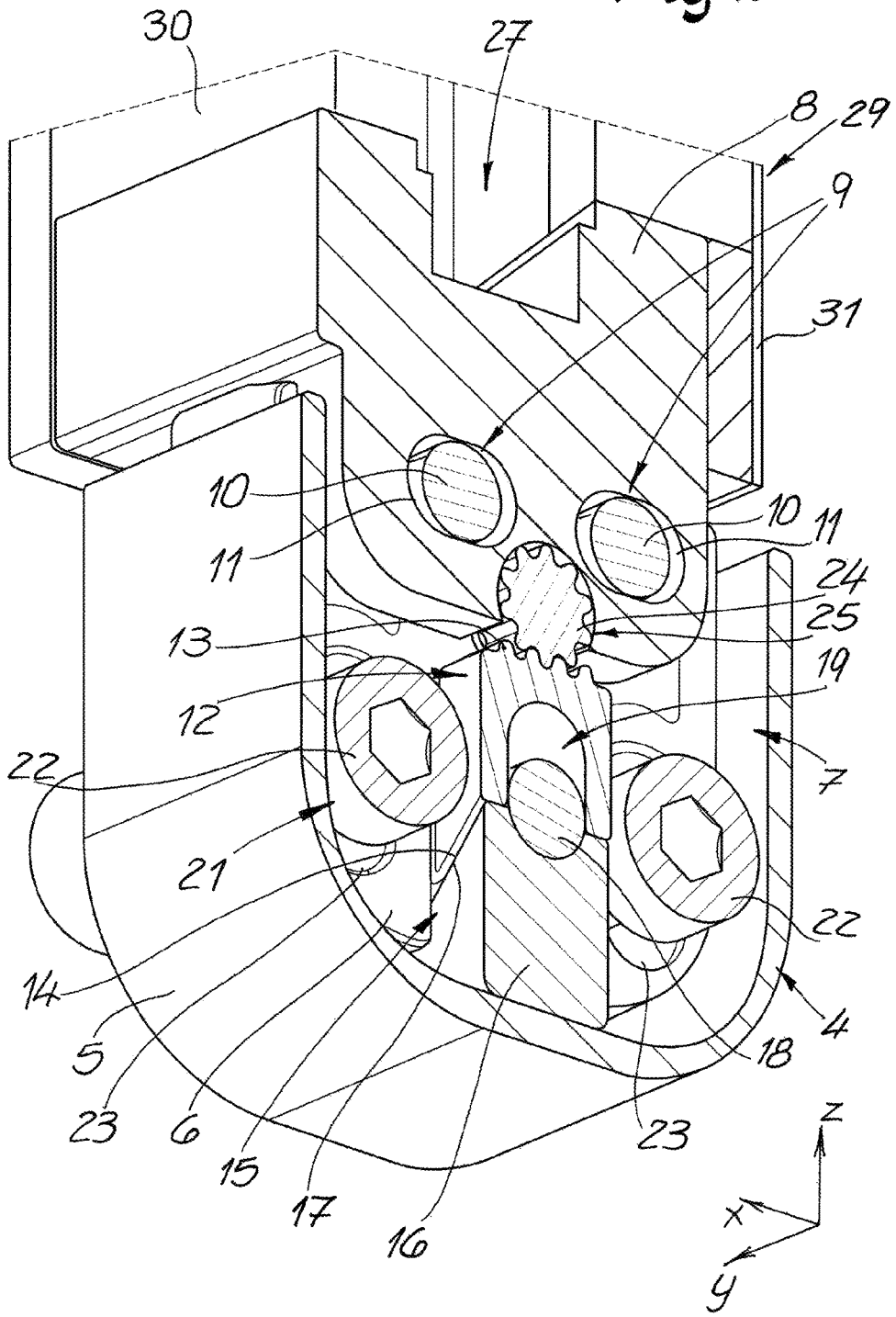
FIG. 2 is a large-scale vertical cross section through part of a hinge housing for a recessed door hinge, in particular for the door hinge illustrated in FIG. 1.
Figure 3:
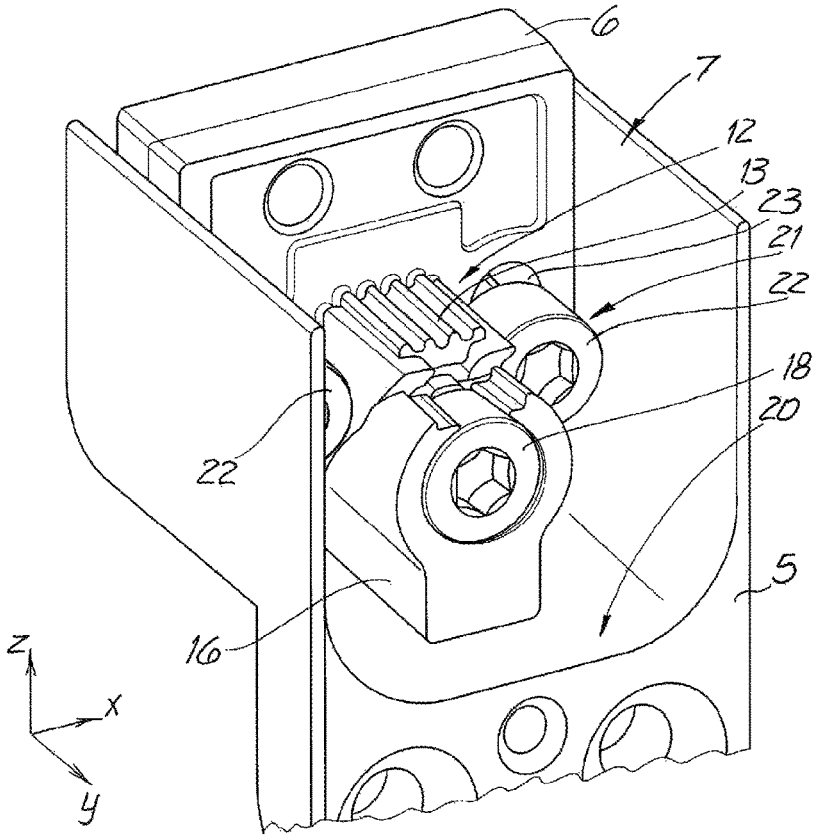
FIG. 3 is a perspective view of a detail of the hinge housing illustrated in FIG. 2.
Figure 4:
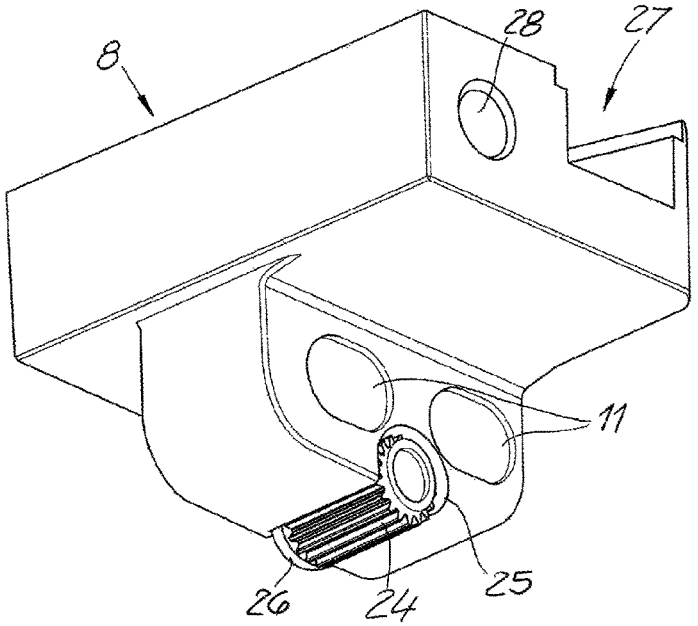
FIG. 4 shows a bearing block of the hinge housing illustrated in FIG. 2.

The hinge housings 4 illustrated in FIGS. 2 to 4 are die cast and intended for a recessed door hinge for doors or windows, and each has a mounting formation or flange 5 for fastening to a frame or a door or a window, a respective support body 6 held in a cavity 7 of each of the housings 4 so as to be vertically adjustable in a z direction, and a respective bearing block 8 resting on the respective body 6 and in which is journaled the respective end of the links of the link assembly 3.

Each bearing block 8 is horizontally shiftable on the respective support body 6 in the x direction and can be fixed to the support body 6 by a screw connection 9. In this embodiment, the screw connection 9 is formed by two parallel and horizontal screws 10 extending in a horizontal y direction through the bearing block 8 and threaded into the support body 6, passing through respective horizontally elongated holes 11 in the bearing block 8. When loosened, the screw connection 9 allows horizontal movement of the bearing block 8 along the support body 6 in a horizontal direction x in order to adjust the contact pressure of the door against a door seal, the so-called compression setting.

As shown in FIGS. 2 and 3, the support body 6 is die-cast and has a projection 12 on which is formed a row of upwardly directed teeth 13. The lower side of the projection 12 facing away from the teeth 13 has an angled wedge face 14 that is acted on by a vertical adjustment device 15. This vertical adjustment device 15 has a wedge 16 with an angled pressure face 17 that is complementary to and slidable on the wedge face 14 of the projection. It may be moved relative to the support body 6 by a screw 18 passing through a vertically elongated but horizontally extending hole 18 in the wedge 16. The wedge face 14 and its associated complementary pressure face 17 are inclined at an angle that is advantageously approximately 45° to the axis A or the vertical direction z.

Movement of the adjustment screw 18 in the y direction exerts a vertical force vector in the z direction on the support body 6. The adjustment screw 18 passes through the hole 19 in the wedge face 14 of the projection 12 that is vertically elongated as a slot to permit relative movement between the wedge 16 and the support body 6 as is necessary for the vertical adjustment of the support body 6. The wedge 16 is supported on a flat horizontal face 20 of the housing 4. Vertical adjustment of the support body 6 is possible under load in that the wedge 16 can accommodate the weight of the door that is transmitted via the articulated joint connection of the link assembly 3.

The support body 6 can be fixed to the mounting flange 5 by a screw connection 21. The screw connection 21 has at least one adjustment screw 22 passing through a vertically elongated throughgoing hole 23 in the support body 6 and threaded into the housing 4. In this embodiment and according to one preferred design, two such adjustment screws 22 and respective holes 23 are provided.

The bearing block 8 has a rotatably mounted pinion gear 24 meshing with the teeth 13 of the short rack fixed on the support body 6, and can horizontally shift the bearing block 8 on the support body 6 if the screw connection 9 is loosened. The bearing block 8 has a part-cylindrical seat 25 complementarily holding the pinion 24, and may be economically manufactured as a die-cast part. The gear seat 25 extends mostly around the pinion 24 through preferably more than 180°. The pinion 24 has a collar 26 engaging behind a countersurface of the bearing block 8 and axially securing the pinion 24 in the gear seat 25.

The bearing block 8 has a groove 27 for longitudinally guiding a first link, and a bearing hole 28 for bearing a second link in a rotatably movable manner.

The first hinge part 1 of the door hinge illustrated in FIG. 1 has two housings 4 carried at opposite ends of a L-section middle part 29. The housing 4, the mounting flange 5, and the support body 6 of the two hinge parts 4 situated therein form separate assemblies which are not part of the middle part 29. The middle part 29 is designed as a thin-walled shell, and has a base 30 and at least one side wall 31 bridging the space between the bearing blocks 8, and has a height that corresponds to the depth of the mortise.

The second hinge part 2 of the door hinge illustrated in FIG. 1 has an adjustment device 32 via which a bearing arrangement of the links of the link assembly 3 is horizontally adjustable in the depth direction of the mortise, that is horizontally parallel to the plane of the door. The door may be laterally adjusted by this adjustment device 32. The adjustment device 32 is therefore also referred to as an adjustment device for lateral adjustment.

We claim:

1. In a hinge having two housings adapted to be recessed in a door frame and a door edge and having a link assembly extending between the housings and having ends pivoted in the housings, the improvement comprising:

a support body vertically shiftable in one of the housings and having a row of teeth extending horizontally in a first direction;

a bearing block supported in the one housing on the support body, forming a pivot for the respective end of the link assembly, formed with a seat open toward the row of teeth, and formed with a throughgoing block hole extending in a second horizontal direction transverse to the first horizontal direction;

a screw threaded into the support body, extending through the block hole, and tightenable to bear on and fix the bearing block on the support body; and a gear captured in the seat of the bearing block, meshing with the row of teeth, and rotatable to shift the bearing block on the support body in the first horizontal direction in an untightened condition of the screw.

2. The hinge defined in claim 1, wherein the block is formed with two of the throughgoing block holes and there two of the screws threaded into the support body and each passing through a respective one of the block holes.

3. The hinge defined in claim 1, wherein the support body is unitarily formed of die-cast metal with a projection formed with the row of teeth.

4. The hinge defined in claim 3, wherein a pressure face of the projection extends at an acute angle to the second direction, the hinge further comprising:

means engaged with the pressure face for vertically shifting the projection, support body, and bearing block.

5. The hinge defined in claim 4, wherein the means engaged with the pressure face includes:

a wedge having a wedge face flatly engaging the pressure face, supported on the one housing, and shiftable on the one housing in the second horizontal direction to vertically move the support body and bearing block; and an actuating element engaged between the one housing and the wedge for moving the wedge in the second horizontal direction.

6. The hinge defined in claim 5, wherein the projection is formed with a projection hole extending in the second horizontal direction and elongated vertically, the actuating element being a screw threaded in the one housing, passing through the projection hole, and bearing in the second direction on the wedge.

7. The hinge defined in claim 5, wherein the support body is formed with at least one throughgoing body hole extending in the second horizontal direction and vertically elongated, the hinge further comprising:

a screw extending through the body hole, threaded in the one housing, and tightenable against the support body to fix the support body against the housing.

8. The hinge defined in claim 1, wherein the bearing block is unitarily formed of die-cast metal with the seat, the seat extending around a rotation axis of the gear by more than 180°.

9. The hinge defined in claim 8, wherein the gear is provided with a collar bearing in the second horizontal direction on the bearing block.

10. The hinge defined in claim 1, wherein linkage has in the one housing first and second links, the bearing block being formed with a groove for horizontally guiding the first link and a bearing hole for rotatably supporting the second link.

11. The hinge defined in claim 1, wherein housing 1 is die cast of metal and forms a cavity receiving for the support body and the bearing block.

12. The hinge defined in claim 1, wherein there are two of the bearing blocks, support bodies, screws, and gears vertically flanking the one end of the link assembly in the one housing.

13. The hinge defined in claim 12, wherein the one housing has two end parts each hold a respective one of the support bodies, and a middle part vertically bridging the end parts and holding the bearing blocks.

14. The hinge defined in claim 13 wherein the middle part is a thin-walled shell having a base and at least one side wall that extend between the end parts.

15. The hinge defined in claim 1, wherein each of the housings is provided with a mounting flange for securing the respective housing to an edge of the door or a door frame.

16. The hinge defined in claim 1, wherein the other of the housings is provided means for adjusting a horizontal depth of the respective end of the link assembly into the other housing.

17. The hinge defined in claim 1, wherein the gear is provided with a formation matable with a tool outside the one housing for rotating the gear and horizontally shifting the bearing block.

* * * * *